US009221287B2

(12) United States Patent
Faber

(10) Patent No.: US 9,221,287 B2
(45) Date of Patent: Dec. 29, 2015

(54) SELF-INKING STAMP

(71) Applicant: COLOP Stempelerzeugung Skopek Gesellschaft m.b.H. & Co. KG., Wels (AT)

(72) Inventor: Ernst Faber, Wels (AT)

(73) Assignee: COLOP Stempelerzeugung Skopek Gesellschaft m.b.H. & Co. KG., Wels (AT)

( * ) Notice: Subject to any disclaimer, the term of this patent is extended or adjusted under 35 U.S.C. 154(b) by 0 days.

(21) Appl. No.: 14/758,604

(22) PCT Filed: Jan. 21, 2014

(86) PCT No.: PCT/AT2014/050023
§ 371 (c)(1),
(2) Date: Jun. 30, 2015

(87) PCT Pub. No.: WO2014/113832
PCT Pub. Date: Jul. 31, 2014

(65) Prior Publication Data

US 2015/0336411 A1 Nov. 26, 2015

(30) Foreign Application Priority Data

Jan. 24, 2013 (AT) ..... A 50051/2013
Jan. 24, 2013 (AT) ..... A 50053/2013

(51) Int. Cl.
*B41K 1/38* (2006.01)

(52) U.S. Cl.
CPC ..... *B41K 1/38* (2013.01)

(58) Field of Classification Search
CPC ..... B41K 1/36; B41K 1/38; B41K 1/40; B41K 1/54; B41K 1/56
USPC ..... 101/103, 104, 108, 109, 327, 333, 334, 101/405, 406
See application file for complete search history.

(56) References Cited

U.S. PATENT DOCUMENTS 3,063,371 A 11/1962 Lowell et al.
5,152,223 A 10/1992 Mairon
(Continued)

FOREIGN PATENT DOCUMENTS

AT 3176 U1 11/1999
AT 004 935 U1 1/2002
(Continued)

OTHER PUBLICATIONS

Anleitung zum Zusammensetzen der Stempel [Instruction for construction of the stamps] [online], [discovered on Nov. 29, 2013]. Discovered on the website: •URL:http//www.vistaprint.de/stempel-montage-anleitung.
aspx?GP=11%2f29%2f2013+5%a29%3a37+Am
&GPS=3026443255&GNF=1•.
(Continued)

*Primary Examiner* — Leslie J Evanisko
(74) *Attorney, Agent, or Firm* — Collard & Roe, P.C.

(57) ABSTRACT

The invention relates to a self-inking stamp (1) comprising a housing (2), in which a stamp unit (5) coupled to an actuation part (3) which can be moved with respect to the housing (2) is mounted by means of axle parts (6), at least one of the axle parts (6) being maintained in a receiving element (7) of the actuation part (3). The receiving element (7) is formed in a bearing projection (8) of the actuation part (3), the bearing projection (8) being covered by a safety frame (15) surrounding the housing (2), arranged on the underside of the actuation part (3) and moving together with the actuation part (3).

10 Claims, 5 Drawing Sheets

(56) References Cited

U.S. PATENT DOCUMENTS

| | | | | |
|---|---|---|---|---|
| 5,743,186 | A | 4/1998 | Liao | |
| 5,768,992 | A | 6/1998 | Daw et al. | |
| 6,067,905 | A * | 5/2000 | Faber | B41K 1/40 101/104 |
| 6,761,114 | B2 | 7/2004 | Koneczny et al. | |
| 7,389,727 | B2 | 6/2008 | Faber | |
| 7,464,643 | B2 | 12/2008 | Pointl | |
| 2004/0007144 | A1 | 1/2004 | Koneczny et al. | |
| 2004/0025727 | A1 | 2/2004 | Faber | |
| 2004/0035310 | A1 | 2/2004 | Zindl | |
| 2005/0056173 | A1 | 3/2005 | Dour | |
| 2005/0066828 | A1 | 3/2005 | Wei | |
| 2006/0000374 | A1 | 1/2006 | Faber | |
| 2006/0162596 | A1 | 7/2006 | Faber | |
| 2007/0169650 | A1 | 7/2007 | Shih | |
| 2009/0229482 | A1 | 9/2009 | Shih | |
| 2010/0170813 | A1 | 7/2010 | Faber | |
| 2011/0277647 | A1 | 11/2011 | Zindl et al. | |
| 2012/0297998 | A1 | 11/2012 | Zehetner et al. | |

FOREIGN PATENT DOCUMENTS

| | | | |
|---|---|---|---|
| AT | 6265 | U1 | 7/2003 |
| AT | 7861 | U1 | 10/2005 |
| AT | 507 692 | A1 | 7/2010 |
| AT | 507 833 | A2 | 8/2010 |
| AT | 414 342 | B | 9/2011 |
| AT | 511 453 | A4 | 12/2012 |
| DE | 634 393 | C | 8/1936 |
| DE | 32 00 551 | A1 | 7/1983 |
| DE | 69601069 | T2 | 6/1999 |
| EP | 0 803 372 | A1 | 10/1997 |
| EP | 0 807 531 | A1 | 11/1997 |
| EP | 1 280 669 | B1 | 2/2007 |
| EP | 1 603 754 | B1 | 8/2007 |
| EP | 1 603 755 | B1 | 8/2007 |
| FR | 2 127 114 | A5 | 10/1972 |
| WO | 01/83226 | A1 | 11/2001 |
| WO | 01/83227 | A1 | 11/2001 |
| WO | 2004/060685 | A1 | 7/2004 |
| WO | 2004/091923 | A1 | 10/2004 |
| WO | 2005/037565 | A1 | 4/2005 |
| WO | 2006/119597 | A2 | 11/2006 |

OTHER PUBLICATIONS

International Search Report in PCT/AT2014/050022, dated Jun. 4, 2014.

International Search Report in PCT/AT2014/050025, dated Aug. 11, 2014.

Austrian Office Action in A 50054/2013, dated Nov. 29, 2013, with English translation of relevant parts.

International Search Report of PCT/AT2014/050023, mailed Jul. 16, 2014.

Austrian Office Action in A 50051/2013, dated Nov. 29, 2013, with an English translation of relevant parts.

Austrian Office Action in A 50053/2013, dated Nov. 29, 2013, with an English translation of relevant parts.

International Search Report of PCT/AT2014/050024, mailed Jul. 8, 2014.

Austrian Office Action in A 50052/2013-1, dated Nov. 29, 2013, with English translation of relevant parts.

* cited by examiner

SELF-INKING STAMP

CROSS REFERENCE TO RELATED APPLICATIONS

This application is the National Stage of PCT/AT2014/050023 filed on Jan. 21, 2014, which claims priority under 35 U.S.C. §119 of Austrian Application Nos. A 50053/2013 filed on Jan. 24, 2013 and A 50051/2013 filed on Jan. 24, 2013, the disclosures of which are incorporated by reference. The international application under PCT article 21(2) was not published in English.

TECHNICAL FIELD

The invention relates to a self-inking stamp comprising a housing in which a stamp unit which is coupled to an actuation part which can be moved with respect to the housing, is mounted by means of axle parts, at least one of said axle parts being maintained in a receiving element of the actuation part.

PRIOR ART

Such a self-inking stamp is known e. g. from U.S. Pat. No. 5,152,223 A, wherein bearing bushings for the support of axle journals of the stamp unit are formed in elevations disposed on the inner side of legs of the actuation part. The length of the legs amounts to more than half of the height of the actuation part and the legs are reinforced by vertical struts adjacent to the elevations. The detachment of an inserted stamp unit is not disclosed in this connection.

The WO 2005/037565 A1 shows a self-inking stamp with separately manufactured bearing parts, which comprise cylindrical bearing recesses for receiving axle journals of a stamp type part. The bearing parts are connected to an actuator arm via snap-lock connections. The stamp type part can be detached from the actuator yoke only together with at least one bearing part, the bearing parts being fixed to the actuator arm in such a way that the bearing parts can be detached by means of a suitable tool only.

In the case of the hand stamp shown in DE 32 00 551 A1, too, it is not the support provided with axle parts that can be detached from the stamp device, but only a pressure plate connected thereto by clamping means. In any case, the axle of the support stays permanently in the stamp housing.

The WO 01/83227 A1 shows a self-inking stamp, the upper actuation part of which comprises elastic lateral retaining tabs, in which receiving elements for engaging the axle ends of the stamping plate carrier are provided. A comparable stamp is shown in U.S. Pat. No. 5,768,992 A, wherein an upper part of a stamp includes flexible fingers comprising recesses for receiving the lateral axle journals of the stamping plate carrier.

The US 2005/0066828 A1 describes a stamper comprising comparably narrow vertical tracks arranged in an upper part, which include continuous holes for receiving the guide pins of a platen carrier.

The AT 004 935 U1, US 2005/0056173 A1, WO 2004/060685 A1, and WO 01/83226 A1 show common designs of self-inking stamps, in which the stamp unit is supported in side face extensions of the actuation parts.

In the stamp shown in the AT 511 453 A4, an extension having a guide notch for the engagement of the guide pins of the pressure plate carrier is provided on the upper part.

The US 2009/0229482 A1 relates to a self-inking stamp comprising a cover that can be snapped on the outside of the housing.

SUMMARY OF THE INVENTION

It is the object of the invention to provide a self-inking stamp of the above mentioned type, the stamp unit of which can be removed from the actuation part easily and without any special tool. In particular, integral stamp units of a relatively simple design are to be exchangeable.

The self-inking stamp according to the invention of the above cited type is characterized in that the receiving element for supporting an axle part of the stamp unit is formed in a bearing projection of the actuation part, said bearing projection being covered by a safety frame surrounding the housing, arranged on the underside of the actuation part and moving together with said actuation part. The comparably narrow, tap-shaped bearing projection extends from the remaining actuation part downwards and is formed preferably integrally with the actuation part. Due to its exposed position, the bearing projection may generally be deformed or bent, respectively, more easily than the wall of the actuation part and thus facilitates the removal of any axle parts inserted in the receiving elements. On the other hand, however, the safety frame serves to reliably prevent the bearing projection from being deformed by mistake. The safety frame holds the bearing projection in a holding position, in which the axle part is anchored rotatably in the recess of the bearing projection. Any involuntary deformation of the bearing projection in a direction along a rotational axis of the stamp unit or any bending of the bearing projection is prevented by the safety frame. In particular, the safety frame keeps the distance constant between two opposite bearing projections. Furthermore, the safety frame protects the bearing projection and covers any continuous aperture, so that blocking of the axle part arranged therein by any trapped foreign matter or by any inadvertent contact on the part of the stamp user is avoided.

If the receiving element of the bearing projection is a through-opening, an axle part supported therein can by detached from the receiving part of the bearing projection by means of applying pressure against the axle part from outside. In addition, upon insertion of a stamp unit, the correct seat of the axle part in the receiving element may be controlled visually.

A connection between the safety frame and the actuation part which is easy and fast to produce and to release, and where the connecting elements in addition are cheap to produce, may be obtained in that a snap-lock connection is provided between the safety frame and the bearing projection. In the case of a snap-lock connection between safety frame and actuation part or bearing projection, a relatively low holding force is required, since the forces acting during operation of the stamp, such as a spring force or a force exerted on the actuation part by the stamp user, do not act on the safety frame but exclusively on the bearing projection via the stamp unit and the axle parts.

In addition, the safety frame may serve to connect several parts of an actuation part, in that snap-lock connections are provided between at least two parts of a multi-part actuation part and the safety frame. The safety factor for holding of the safety frame on the actuation part may be improved by several snap-lock connections. In addition, the safety frame has the advantage of the entire device being capable of being disassembled in an easy manner.

To prevent the safety frame from being accidentally pulled off the actuation part, it is favourable if the safety frame essentially continues with the actuation part in a flush manner, at least in parts. Thus it can be avoided that the stamp user supports himself on a projecting safety frame when making a stamp impression. Since the safety frame surrounds the housing and is used for covering the bearing projection, the outer dimensions of the safety frame must exceed at least in part the outer dimensions of the housing as well as the bearing projections. Nevertheless, to obtain a stamp as compact as possible, it is desirable to have a flush finish with the actuation part which likewise surrounds the housing.

To prevent dirt from entering the region between the stamp unit and an ink pad, or stamping ink from exiting the ink pad and to cover a gap between the safety frame and the actuation part, the safety frame may overlap the actuation part in the region of a frame ledge.

Furthermore, it has proven advantageous if the safety frame has guiding gibs on an inner side facing the housing, which are in engagement with corresponding guide elements arranged on an outer side of the housing. This favours the fact that the safety frame aligned correctly at an early stage is placed upon the housing and the safety frame is reliably protected against getting out of place, in particular rotating, e. g. in the case of a round housing.

For the protection of the stamp unit in a compact transport position of the self-inking stamp a stamp cover having snap-lock elements may be provided, which snap-lock elements are arranged for connecting the stamp cover to the actuation part, in particular to the bearing projection. When connecting the stamp cover, which by nature is arranged on the underside of the stamp, to the actuation part, the self-inking stamp is held in a transport position. The bearing projection forms an undermost portion of the actuation part, so that comparably small snap-lock elements on the stamp cover are necessary and the stamp cover as such, i. e. once it will be detached from the stamp, can be stowed away in an essentially flat and simple manner.

In the case that apertures for receiving the snap-lock elements of the stamp cover are provided between a safety frame and the housing, i. e. laterally from the bearing projection, this may improve the reliability of the snap-lock connection between the stamp cover and the actuation part, since the snap-lock connections, just like the bearing projection, are covered and protected by the safety frame.

For removing the stamp cover it has turned out to be particularly useful if the housing comprises at least one unlocking guide, in particular an unlocking ramp, which is arranged for guiding at least one locking element disposed on the actuation part by moving the housing relative to the actuation part. The stamp cover may be detached by means of such an unlocking guide by pressing the locking element, since under the force applied the locking element moves along, in particular glides along the locking guide, which is inclined at an acute angle to a direction of movement of the housing relative to the actuation part, and due to the movement of the housing also moves a stamp cover adjacent thereto or which closing the same and removes it from the actuation part. The unlocking guide preferably terminates in a receiving element for the locking element having a stop surface placed perpendicularly to the direction of movement, so that after releasing the stamp cover an immediate and jerky, full extension of the housing out of the actuation part may be blocked at least for the time the locking element is actuated.

BRIEF DESCRIPTION OF THE DRAWINGS

In the following, the invention will be further described by way of particularly preferred embodiments, however, to which it shall not be limited, and with reference to the drawings, in which in detail.

DETAILED DESCRIPTION OF THE DRAWINGS

Figure 1:
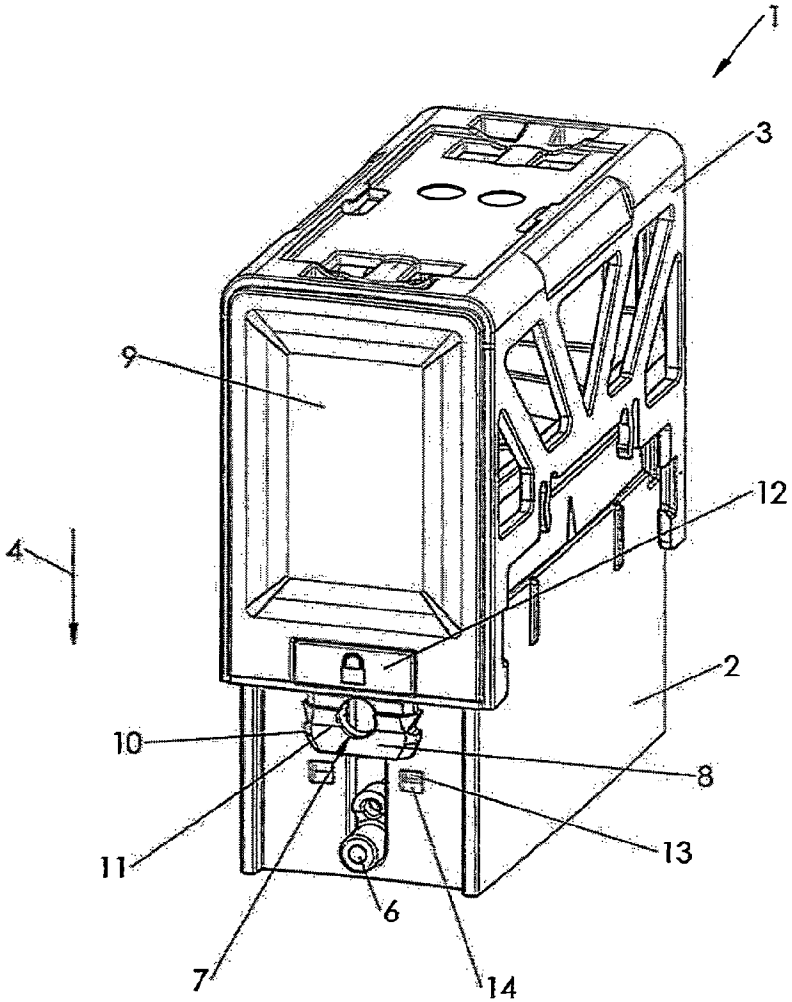
FIG. 1 shows a perspective view of a self-inking stamp comprising bearing projections on the actuation part.

FIG. 1 shows a self-inking stamp 1 comprising a housing 2 and an actuation part 3. The actuation part 3, also called actuation yoke, is moveable with respect to the housing 2 in a direction of movement 4. In the housing 2, a stamp unit 5 (cf. FIGS. 3 and 4) comprising axle parts 6 opposite to each other is arranged. The two pin-shaped axle parts 6 are arranged each for being supported in a receiving element 7 of the actuation part 3, which are formed each in a bearing projection 8 of the actuation part 3. In the position of the stamp 1 shown in FIG. 1, the stamp unit 5 is placed in the housing 2 and prepared for connection to the actuation part 3. Said connection, i. e. insertion of the axle parts 6 into the receiving elements 7 of the bearing projections 8, can be effected from the position shown by means of pressing the actuation part 3 downwards, whereby the axle parts 6 glide along the inner sides of the bearing projections 8 bent outwards thereby until they engage with the receiving elements 7. On the other hand, if the stamp unit 5 is to be dismounted, the bearing projections 8 will be spread somewhat apart to release the axle parts 6, so that the stamp unit 5 can be removed. If the receiving elements 7 are through-openings, apertures in the bearing projections 8, the axle parts 6 received therein are preferably accessible and visible from the outside. As a result, the stamp unit 5 can be rotated about an axis of rotation extending through the two axle parts 6. The bearing projection 8 essentially corresponds to a narrower, plate-like continuation of a side wall 9 of the actuation part 3. The otherwise flat bearing projection 8 comprises snap-lock elements 10, 11 on its narrow, lateral outer edges as well as on the outer surface facing away from the housing 2.

If the stamp unit 5 is to be detached from or taken out of the self-inking stamp, the axle parts 6 of the stamp unit 5 can be detached from the receiving element 7 of at least one bearing projection 8 in a simple manner. All that needs to be done is to remove the bearing projection 8 from the stamp unit 5, for example, by bending, along the rotational axis so that the end of the axle part 6 arranged in its receiving element 7 leaves the receiving element 7 and thus becomes freely movable.

Furthermore, FIG. 1 shows a locking or latching element 12 in the form of a push button. The locking element 12 is movably supported in the actuation part 3 and can be slidably moved in particular perpendicularly to a side wall 9 of the actuation part 3. In this connection, projections of the locking element 12, protruding into the interior of the actuation part 3, touch the housing 2. In particular, the self-inking stamp 1 can be held in a more compact support position (not shown), when the projections of the locking element 12 are received in a snap-lock receiving element 13 on the housing 2. The snap-lock receiving elements 13 of the housing 2 preferably comprise unlocking guides 14 of the type of unlocking ramps on the underside. The unlocking guides 14 form a surface which is inclined with respect to the direction of movement 4, the inclination extending transversely downwards to the exterior side of the housing 2. Thus, a projection of the locking element 12 arranged opposite the unlocking guide 14 can slip off the inclined surface, whereby the housing 2 is moved downwards with respect to the actuation part 3.

Figure 2:
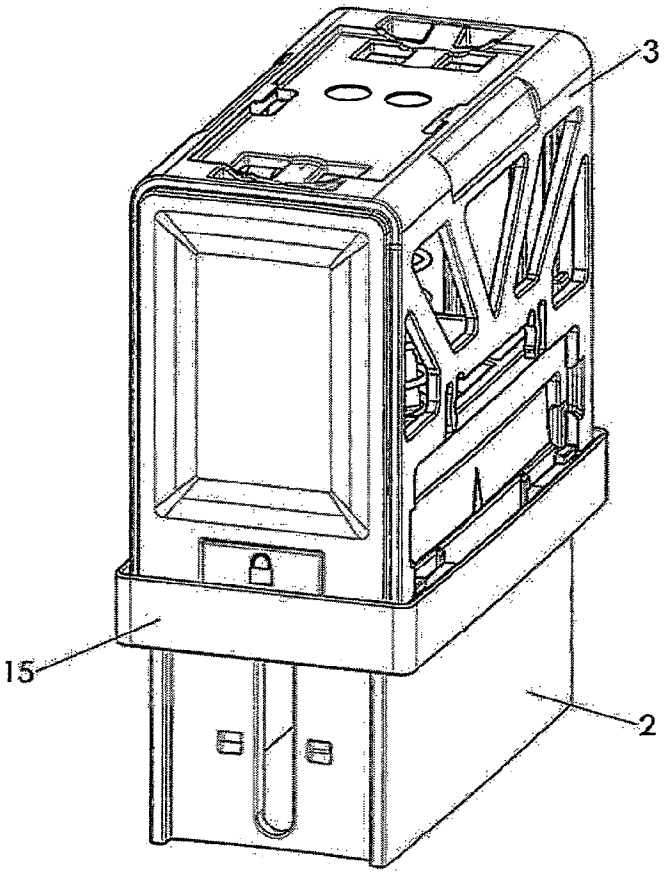
FIG. 2 shows a perspective view of such a self-inking stamp comprising a safety unit.

FIG. 2 shows a self-inking stamp 1 as in FIG. 1, wherein the bearing projections 8—as compared to FIG. 2—are covered by a safety frame 15 and are not visible for this reason. The safety frame 15 is arranged on the underside of the actuation part 3 and connected to the actuation part 3 via its bearing projections 8 for joint movement (cf. FIG. 3). Upon actuating the actuation part 3 and moving the actuation part 3 with respect to the housing 2, the safety frame 15 will follow the actuation part 3 and likewise move with respect to the stamp housing 2. The safety frame 15, which in comparison to the actuation part 3 is low, preferably surrounds the housing 2, so that an outward movement of the bearing projections 8 with respect to the axle parts 6 of the stamp unit 5 is blocked. With the safety frame 15 being properly applied on the bearing projections 8, any undesirable detachment of the stamp unit 5 from the self-inking stamp 1 becomes impossible.

Figure 3:
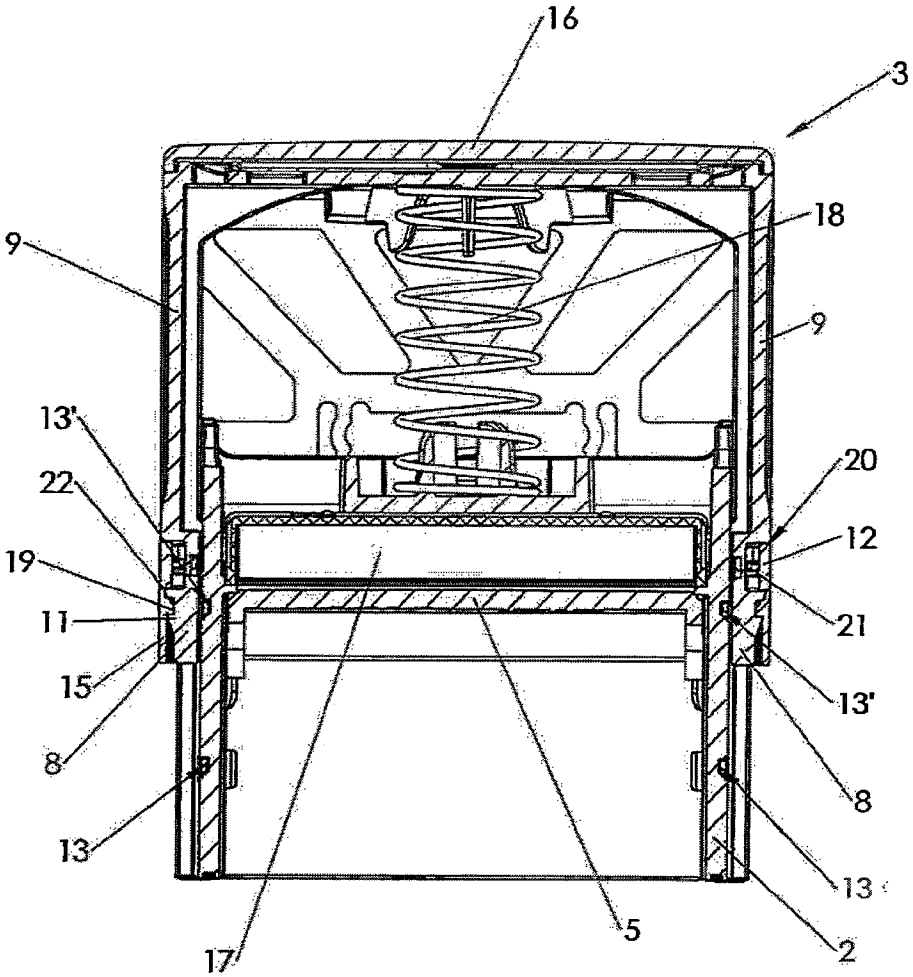
FIG. 3 shows a sectional view of a self-inking stamp in parallel to a rotational axis of the stamp unit.

The self-inking stamp 1 shown in FIG. 3 in a vertical longitudinal section essentially corresponds to the self-inking stamp 1 shown in FIG. 2, the actuation part 3 additionally comprising a detachable, U-shaped cover yoke 16. Inside the housing 2 the stamp unit 5 can be seen, which is in contact with an ink pad 17 in the shown stamp inking position.

The actuation part 3 is pushed away from the housing 2 in a manner known per se by means of the force of a spring 18. As can also be seen here, the bearing projections 8 of the actuation part 3 form a continuation of the sidewalls 9. The snap-lock elements 11 arranged on the outside of the bearing projections 8, together with corresponding snap-lock elements 19 in the safety frame 15, form snap-lock connections fixing the safety frame 15 with respect to the actuation part 3.

A recess 20 for receiving a locking element 12, also briefly called a catch 12, is provided in each of the sidewalls 9 of the actuation part 3, whereby a projection 21 of the locking element 12 projects through the sidewall 9 and can come into contact with the housing 2, in particular with one of the receiving elements 13, 13' on the housing 2. Apart from the locking element 12, which in turn terminates flush with the sidewall 9 of the actuation part 3, the safety frame 15 continues the actuation part 3 downwards in a flush manner, i. e. the outer dimensions of the safety frame 15 correspond to those of the actuation part 3. To additionally improve the connection between the safety frame 15 and the actuation part 3 and to cover a gap between the safety frame 15 and the actuation part 3, a frame ledge 22 is adapted on the safety frame 15 and overlaps the bottom edge of the actuation part 3 with a correspondingly adapted stepping or groove 23 (cf. FIG. 7).

Figure 4:
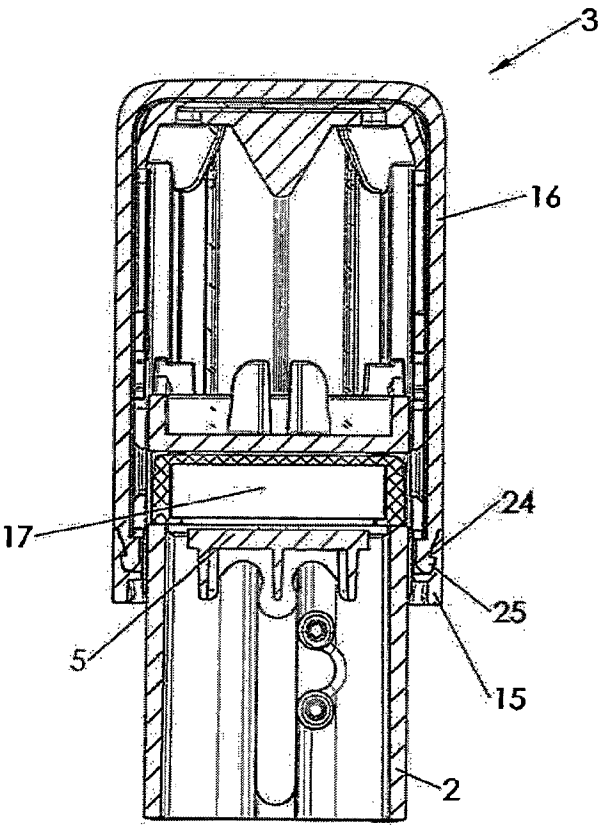
FIG. 4 shows a sectional view of the self-inking stamp according to FIG. 3 transverse to the rotational axis of the stamp unit.

Apart from being connected to the bearing projections 8, the safety frame 15 can also be connected to the cover yoke 16 of the actuation part 3 by means of a snap-lock connection. As shown in FIG. 4, specific snap-lock elements 24 can engage in the safety frame 15 with corresponding snap-lock elements 25 on the cover yoke 16, e. g. a window part, so that the actuation part 3 is held together by the safety frame 15. In this connection, the snap-lock elements 25 on the cover yoke 16 are offset towards the inside with respect to the housing 2 in such a way that the safety frame 15—similar to what is described for the sidewalls 9 in connection with the FIG. 3—continues the cover yoke 16 in a flush manner.

Figure 5:
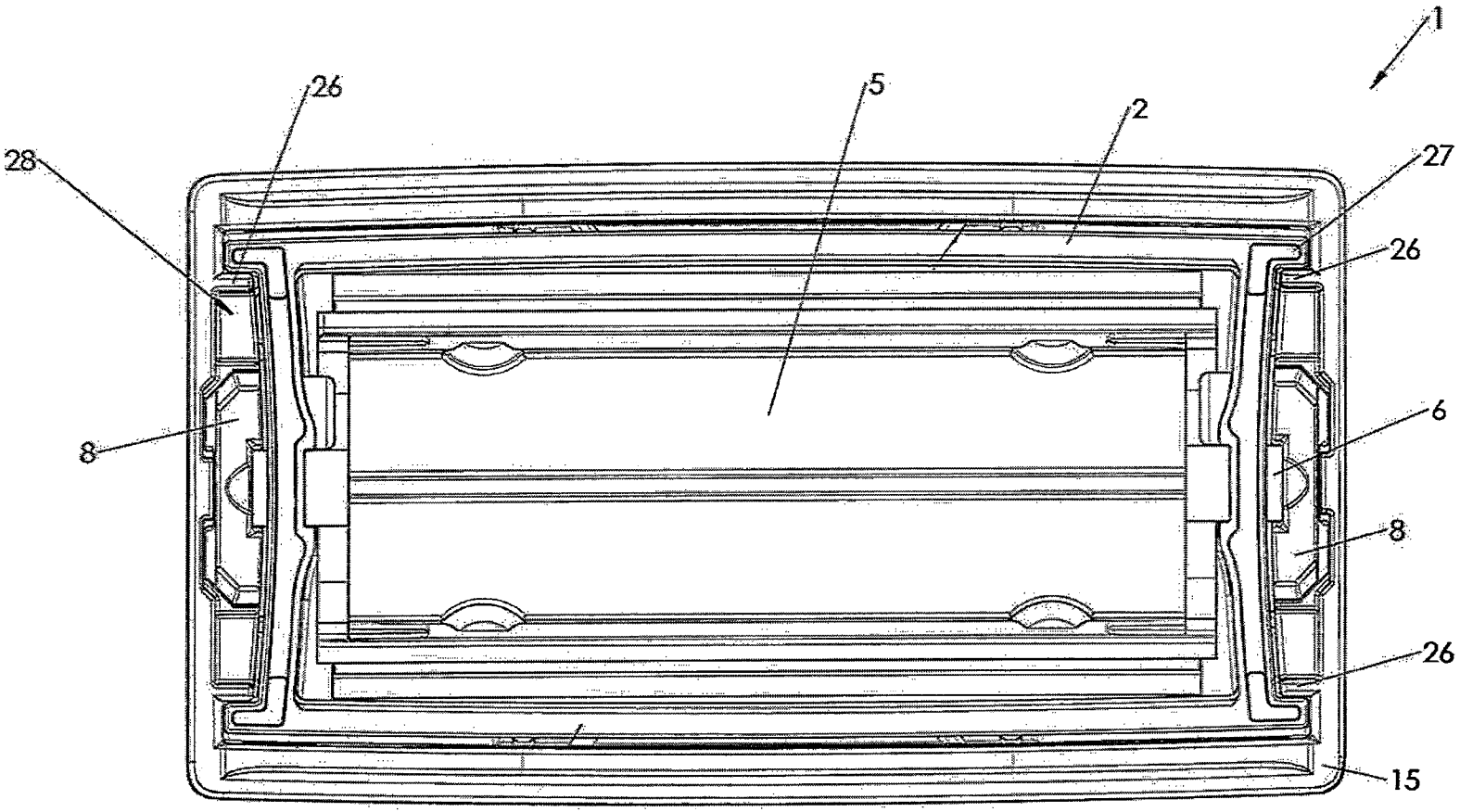
FIG. 5 shows a bottom view of the self-inking stamp according to FIGS. 3 and 4.

FIG. 5 shows a bottom view of the self-inking stamp 1 according to FIG. 3 and FIG. 4 likewise in a stamp inking position. Accordingly, in housing 2 the underside of the stamp unit 5 is shown. The housing 2 is surrounded by the safety frame 15, the actuation part 3 not projecting outwards at any point beyond the outer contour of the safety frame 15. Vertical guiding gibs 26, i. e. guiding gibs that are aligned in parallel to a direction of movement 4, are formed on an inner side of the safety frame 15 facing the housing 2. These guiding gibs are in engagement with corresponding guide elements 27 arranged on the outer side of the housing 2 facing the safety frame 15, so that the mobility of the safety frame 15 is limited by the guide elements 27 to a movement in parallel to the direction of movement 4. In particular, due to the guiding gibs 26 and the guide elements 27, the safety frame 15 can be aligned with respect to the housing 2 already at an early time when applying the safety frame 15. The width of the bearing projections 8 received in the safety frame 15 is smaller than the distance between the guiding gibs 26 and preferably not larger than about three times the diameter of the axle parts 6. Preferably, at least one aperture 28 for receiving snap-lock elements 29 of a stamp cover 30 (cf. FIG. 7) can remain within the safety frame 15, laterally of the bearing projections 8 or between the bearing projections 8 and the guiding gibs 26.

Figure 6:
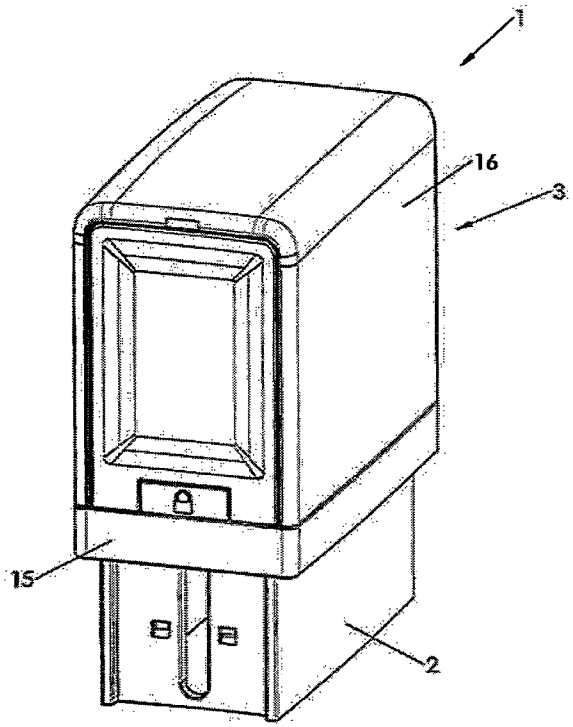
FIG. 6 shows a perspective view of the self-inking stamp according to FIGS. 3 to 5 in a stamp inking position.

FIG. 6 shows a perspective view of the self-inking stamp 1 according to FIGS. 3 to 5. The safety frame 15 surrounds the housing 2, covers the bearing projections 8 and the snap-lock elements 25 of the cover yoke 16 of the actuation part 3, and is flush with the latter or continues flush with it along the entire circumference of the underside of the actuation part 3.

Figure 7:
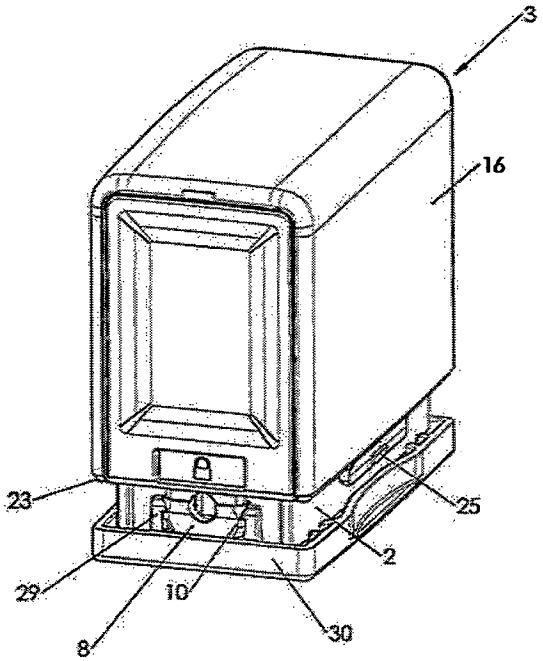
FIG. 7 shows a perspective view of the self-inking stamp according to FIGS. 3 to 6 without a safety frame and in a transport position.

FIG. 7 shows the self-inking stamp 1 according to FIGS. 3 to 6 in a transport position and, for the sake of illustrating the underlying elements, without safety frame 15. The snap-lock elements 25 of the cover arm 16, which are formed in certain zones on a bottom edge of the cover yoke 16, can also be seen. As is shown, the snap-lock elements 10 provided on the narrow outer edges or side edges of the bearing projection 8 can be brought in engagement with the corresponding snap-lock elements 29 of the stamp cover 30, so that there exists a snap-lock connection between the stamp cover 30 and the actuation part 3, formed to which is the bearing projection 8. Said snap-lock connection is preferably covered and protected by the safety frame 15 whenever a safety frame 15 is used, as can be seen from FIG. 8.

Figure 8:
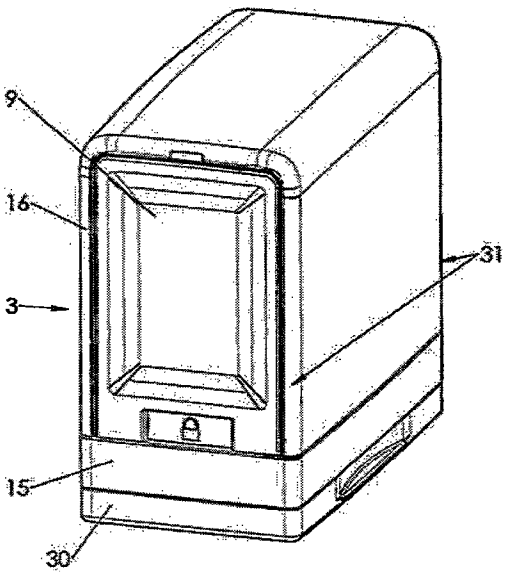
FIG. 8 shows a perspective view of the self-inking stamp according to FIG. 7 with a safety frame.

The outer contour of the cover part 30 preferably corresponds to that of the safety frame 15, so that in the transport position shown in FIG. 8 the self-inking stamp 1 comprising the stamp cover 30 essentially forms a rectangular parallelepiped, with at least the four vertical side edges 31 being continuous and straight.

Figure 9A:
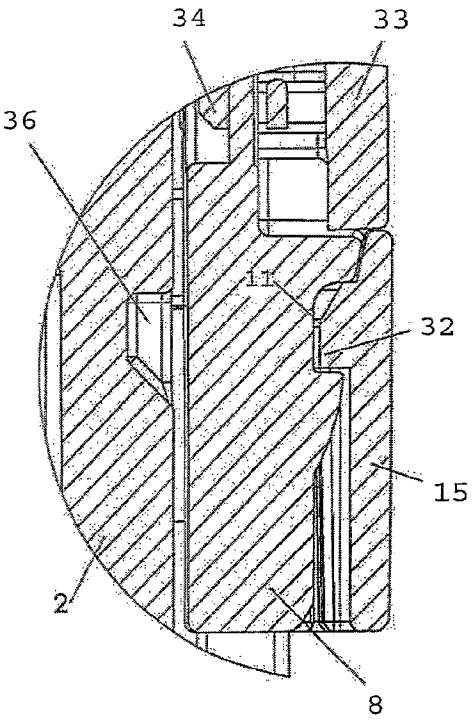
FIG. 9A shows, on an enlarged scale, the detail shown by circle IX in FIG. 9, for better illustration of the snap-lock connection between the actuation part and the separate safety frame.
Figure 9:
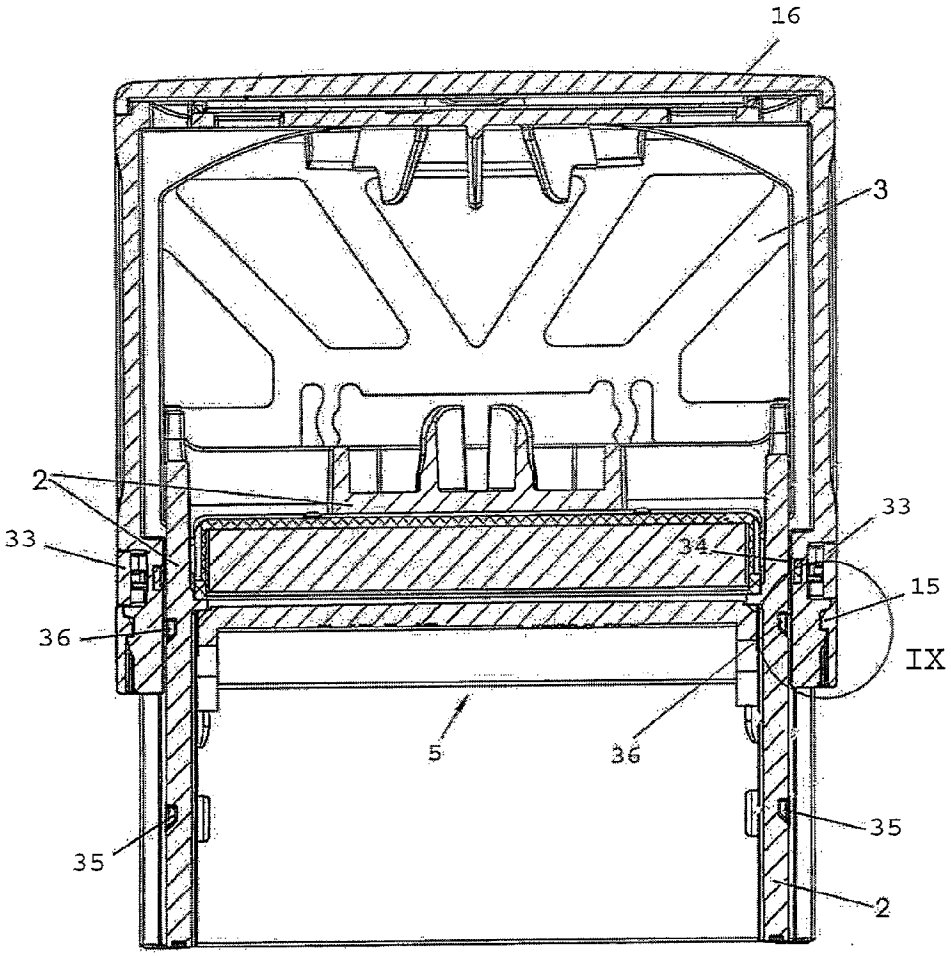
FIG. 9 shows a vertical longitudinal section of the stamp, illustrating the snap-lock connection between the actuation part and the safety frame.

The elongated snap-lock element 11 transversely extending along the bearing projection 8 serves to fix the separate safety frame 15 via a snap-lock projection 32 provided thereon by means of locking. In particular, said snap-lock connection is illustrated in FIG. 9 and FIG. 9A, respectively. It can be seen that the safety frame 15, with e. g. a ledge-shaped snap-lock projection 32, snaps in place in the snap-lock recess forming the snap-lock element 11 when the safety frame 15 is connected to the actuation part 3, specifically with its bearing projections 8.

Furthermore, it can be seen from FIGS. 9 and 9A that a locking element 33 is provided each on the two narrow sides, on the actuation part 3 above the bearing projections 8, which locking element 33 is elastically movable inwards relative to the remaining actuation yoke 3, for example, via an elastic connection to the remaining actuation yoke 3; having projections 34 (FIG. 7) on the inner side, said locking element 33 forms a lock or catch, which interacts with corresponding locking recesses 35, 36 on the narrow sides of the housing 2, to be able to specifically fix the actuation yoke 3 to the housing 2 at different predetermined positions.

The invention claimed is:

1. Self-inking stamp (1) comprising a housing (2), in which a stamp unit (5), which is coupled to an actuation part (3) which can be moved with respect to the housing (2), is mounted by means of axle parts, at least one of said axle parts (6) being maintained in a receiving element (7) of the actuation part (3), wherein the receiving element (7) is formed in a bearing projection (8) of the actuation part (3), said bearing projection (8) being covered by a safety frame (15) surrounding the housing (2), arranged on the underside of the actuation part (3) and connected to said actuation part (3) for common movement.

2. Self-inking stamp (1) according to claim 1, wherein the receiving element (7) of the bearing projection (8) is a through-opening.

3. Self-inking stamp (1) according to claim 1, wherein a snap-lock connection is provided between the safety frame (15) and the bearing projection (8).

4. Self-inking stamp (1) according to claim 1, wherein snap-lock connections are provided between at least two parts (9, 16) of a multi-part actuation part (3) and the safety frame (15).

5. Self-inking stamp (1) according to claim 1, wherein the safety frame (15) at least partly in certain zones continues essentially flush with the actuation part (3).

6. Self-inking stamp (1) according to claim 1, wherein the safety frame (15) overlaps the actuation part (3) in the area of a frame ledge (22).

7. Self-inking stamp (1) according to claim 1, wherein the safety frame (15) comprises guiding gibs (26) on an inner side facing the housing (2), which engage with guide elements (27) disposed on an exterior side of the housing (2).

8. Self-inking stamp (1) according to claim 1, comprising a stamp cover (30) with snap-lock elements (29), which are arranged for connecting the stamp cover (30) to the actuation part (3), in particular to the bearing projection (8).

9. Self-inking stamp (1) according to claim 8, wherein apertures (28) for receiving the snap-lock elements (29) of the cover part (30) are provided between the safety frame (15) and the housing (2) at the side of the bearing projection (8).

10. Self-inking stamp (1) according to claim 8, wherein the housing (2) comprises at least one unlocking guide (14), in particular an unlocking ramp, which is arranged for guiding at least one locking element (12) provided on the actuation part (3), with the housing (2) being moved relative to the actuation part (3).

* * * * *